US007779740B1

(12) United States Patent
Holmes et al.

(10) Patent No.: US 7,779,740 B1
(45) Date of Patent: Aug. 24, 2010

(54) REVOLVING FIRING PIN ASSEMBLY

(75) Inventors: Edward Holmes, Valley Falls, NY (US); Lee Bennett, Voorheesville, NY (US); Donald Forkas, Rexford, NY (US); George Hathaway, IV, Sprakers, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 338 days.

(21) Appl. No.: 12/008,782

(22) Filed: Jan. 10, 2008

(51) Int. Cl.
*F41A 19/27* (2006.01)

(52) U.S. Cl. ..... 89/27.12; 89/27.14; 42/70.08

(58) Field of Classification Search ..... 89/27.11, 89/27.12, 27.3, 28.05, 19, 27.14; 42/69.01, 42/70.08

See application file for complete search history.

(56) References Cited

U.S. PATENT DOCUMENTS 466,320 A * 1/1892 Benet ..... 89/26
2,517,333 A * 8/1950 Motley ..... 89/1.803
2,741,161 A * 4/1956 Musser ..... 89/28.05
2,800,057 A * 7/1957 Hoopes ..... 89/28.05
3,390,609 A * 7/1968 Reepmeyer ..... 89/27.11
3,501,998 A * 3/1970 Dardick ..... 89/156
3,648,561 A * 3/1972 Stoner ..... 89/11
3,877,378 A * 4/1975 Clark et al. ..... 102/207
4,246,830 A * 1/1981 Krieger ..... 89/179
4,263,836 A * 4/1981 Koine ..... 89/26
4,329,908 A * 5/1982 Rowlands ..... 89/24
4,348,937 A * 9/1982 Kuffer ..... 89/24
4,548,121 A * 10/1985 Janssen et al. ..... 89/26
5,229,539 A * 7/1993 Rommel ..... 89/27.14
5,325,760 A * 7/1994 Dennis ..... 89/25

* cited by examiner

*Primary Examiner*—Benjamin P Lee
(74) *Attorney, Agent, or Firm*—Michael C. Sachs

(57) ABSTRACT

A revolving firing pin system is mechanically linked to a screw-block in a breech-loading mortar system, wherein the revolver firing pin assembly rotates on a centerline that is offset from the centerline of the screw-block assembly. When the revolver firing pin assembly is rotated, the firing pin assembly also rotates. However, until the screw-block assembly is locked, the firing pin is in a safety position that is not in line with the primer of the munition loaded into the mortar system. Only when the screw-block is rotated into a locked position does the firing pin align with the primer of the munition to thus be able to strike the primer when the solenoid is electronically actuated.

7 Claims, 5 Drawing Sheets

REVOLVING FIRING PIN ASSEMBLY

U.S. GOVERNMENT INTEREST

The inventions described herein may be manufactured, used and licensed by or for the U.S. Government for U.S. Government purposes.

FIELD OF THE INVENTION

The present invention generally relates to a screw block assembly for a breech-loaded weapon, the screw-block assembly comprising a firing pin for a weapon such as having a cannon, or such as in a 120 MM breech loaded Mortar weapon. In particular, the present invention relates to aligning of a firing pin in a safety position when the screw-block breech is not closed and locked.

BACKGROUND OF THE INVENTION

In comparison to muzzle-loaded weapons, breech-loaded weapons are advantageous in that ammunition is loaded through the breech of the weapon rather than the muzzle of the weapon. Consequently, breech-loaded weapons allow faster operation and improve personnel safety. Modern breech-loaded mortar weapons typically rely on modifications to ammunition or use heavy slide-block breeches. Although this technology has proven to be useful, it would be desirable to present additional improvements.

Conventional mortar ammunition relies on an electronically operated firing pin to strike a percussion-type primer, initiating firing. The electronically operated firing pin typically comprises a solenoid plunger for actuating the firing pin. It is possible that upon closing the breech block, the inertia of the breech block and the solenoid plunger is sufficient to actuate the firing pin. This actuation may permit the firing pin to strike the primer and can lead to premature firing. Premature firing can result in damage to the cannon assembly and injury to the cannon system user; i.e., a soldier. Ammunition used in conventional breech-loaded weapons is typically modified to prevent premature firing. Modifying ammunition for use of conventional mortar ammunition in a breech-loaded system is both costly and time-consuming.

Thus, there is need for a revolving firing pin system for a screw-block breech-loading mortar system to prevent premature firing without requiring modification of ammunition. The need for such a system has heretofore remained unsatisfied.

SUMMARY OF THE INVENTION

The present invention satisfies this need, and presents a system and an associated method (collectively referred to herein as "the system" or "the present system") for a revolving firing pin system for a screw-block breech of a mortar system to prevent premature firing by an electrically operated firing system.

The present system is mechanically linked to the screw-block assembly for a breech-loading mortar system. When the screw-block assembly is rotated, the present system further rotates on a centerline that is offset from the centerline of the screw-block assembly. When the screw-block assembly is rotated, the firing pin also rotates. However, until the screw-block assembly is locked the firing pin is in a safety position that is not in line with the primer of the munition loaded into the mortar system. Only when the screw-block assembly is rotated into a locked position does the firing pin align with the primer of the munition to thus be able to strike the primer when the firing pin is electronically actuated.

The present system enables screw-block breech-loading mortar systems that enhance personnel safety. The screw-block breech-loading mortar system utilizing the present system may be transported while loaded with ammunition without the ammunition being accidentally fired. The mortar ammunition can only be fired when the screw-block breech is rotated and locked in position.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF PREFERRED EMBODIMENTS

Figure 1:
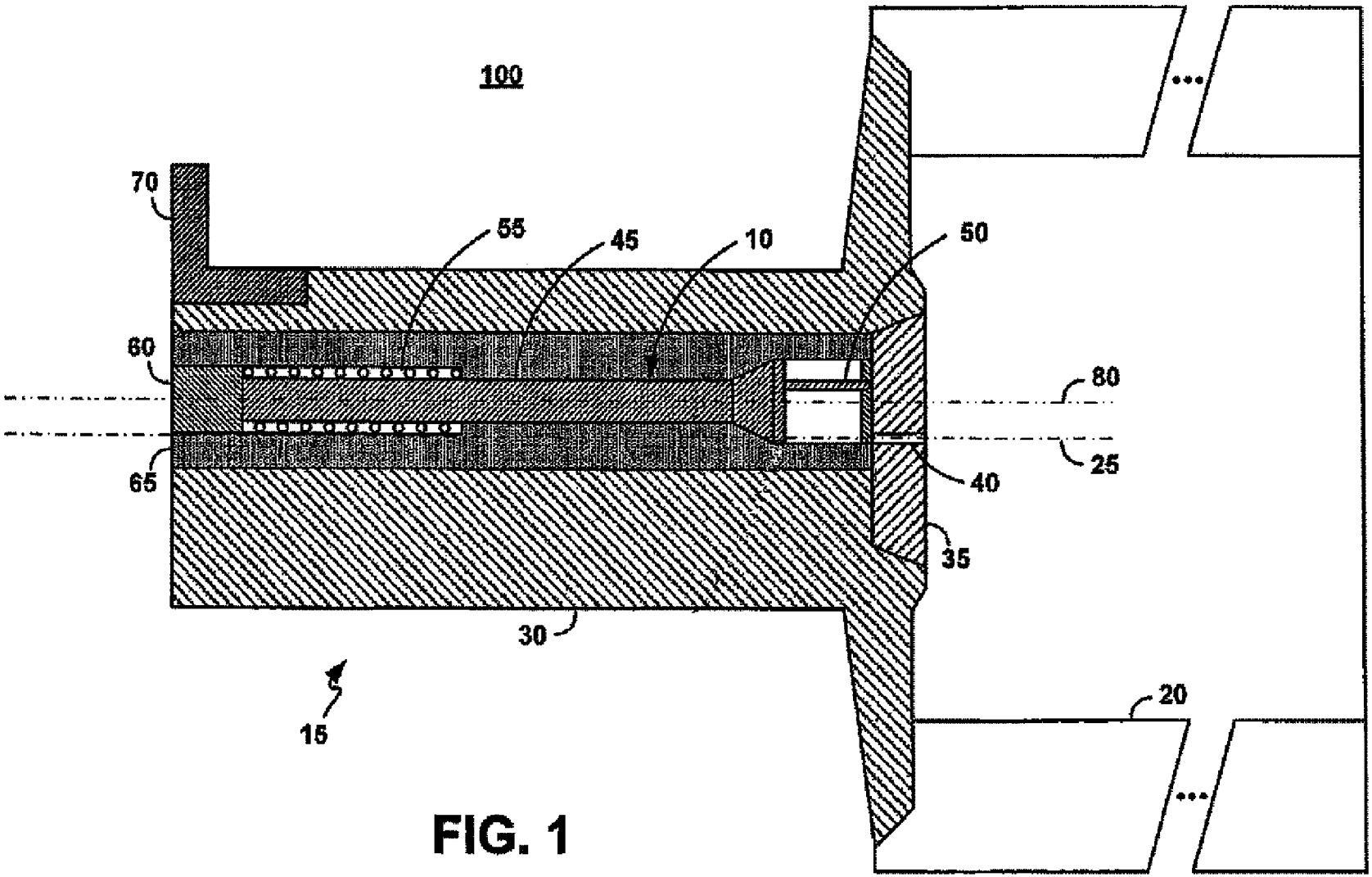
FIG. 1 is a schematic illustration of an exemplary screw-block breech-loading mortar system in which a firing pin system of the present invention can be used and in which a screw-block assembly is closed and not locked.

The following definitions and explanations provide background information pertaining to the technical field of the present invention, and are intended to facilitate the understanding of the present invention without limiting its scope:

FIG. 1 illustrates an exemplary high-level cross-section diagram of a screw-block breech-loading weapon system 100 (interchangeably referenced herein as the mortar system 100 or the weapon system 100) comprising a revolving firing pin system 10 (interchangeably referenced herein as system or screw block assembly) that is mounted onto a canon (or weapon 20) at a proximal end, and a solenoid 45 at a distal end.

The screw block assembly 15 comprises a spindle 30 and a spindle cap 35. The spindle cap 35 comprises a firing pin hole 40 that is offset relative to a center axis of the firing pin system. The spindle 30 houses a revolver firing pin assembly 65 that rotates around a spindle axis 25. The revolver firing pin assembly 65 comprises a firing pin 50, a spring 55, a firing pin guide 60, and a revolver link 70. The revolver firing pin assembly 65 rotates around a firing pin system center axis 80. The firing pin system center axis 80 is offset relative to spindle axis 25 by, for example, approximately 5 mm.

The spindle cap 35 is connected to the proximal end of the revolver firing pin assembly 65; and serves to keep the firing pin 50 from turning. The firing pin 50 rotates with the revolver firing pin assembly 65. The revolver link 70 forms part of a driver assembly 77 that acts as a clutch to allow the removal of the firing pin 50 if it becomes stuck or damaged.

System 10 has a length of approximately 127 mm and a diameter of approximately 8 mm. The firing pin 50 includes a contact finger that has a length of approximately 17.5 mm and a diameter of approximately 3 mm. The firing pin hole 40 has a diameter of approximately 3 mm.

FIG. 1 shows the screw block assembly 15 closed and not locked. When the screw block assembly 15 is not locked, the firing pin 50 is in a "safety position" that is out of alignment with the firing pin hole 40, located on a bore side of the spindle 30. When the mortar system 100 is loaded with ammunition and screw block assembly 15 is closed and locked, the firing pin 50 is rotated into alignment with the firing pin hole 40. This rotation is actuated by the revolver link 70. As the screw block assembly 15 rotates to the fully closed and locked position, a groove in the screw block 15 drives the revolver link 70, rotating the revolver firing pin assembly 65. The rotation of the revolver firing pin assembly 65 rotates the firing pin 50 into alignment with the firing pin hole 40.

The spindle cap 35 and the corresponding sealing surface of the firing pin 50, keep the breech area clean so that the firing pin 50 can rotate into and out of alignment with the firing pin hole 40, and so that the firing pin 50 can be extended through the firing pin hole 40.

The spring 55 keeps the firing pin 50 sealed against the revolver firing pin assembly 65. The spring 55 pushes against the revolver firing pin assembly 65 and against the firing guide 60, to keep the firing pin 50 sealed against the revolver firing pin assembly 65.

The solenoid 45 actuates the firing pin 50, extending the firing pin 50 through the firing pin hole 40 to strike a munition. The solenoid 45 then retracts the firing pin 50. When the solenoid 45 is activated, the spring 55 pushes the firing pin 50. However, when the solenoid is deactivated, it causes the firing pin 50 to retract back into its sealing position.

The spindle cap 35 is generally formed of a disk provided with the hole 40 and a key. The key will maintain the position of the revolver firing pin assembly 65, so that when the revolver firing pin assembly 65 turns, it will be in alignment with the spindle cap 35.

Rotating the screw block assembly 15 out of the closed and locked position rotates the firing pin 50 into a "safety" position that is out of alignment with the firing pin hole 40, ensuring safe operation of the mortar system 100 and preventing accidental firing of ammunition loaded in the mortar system 100.

Figure 2:
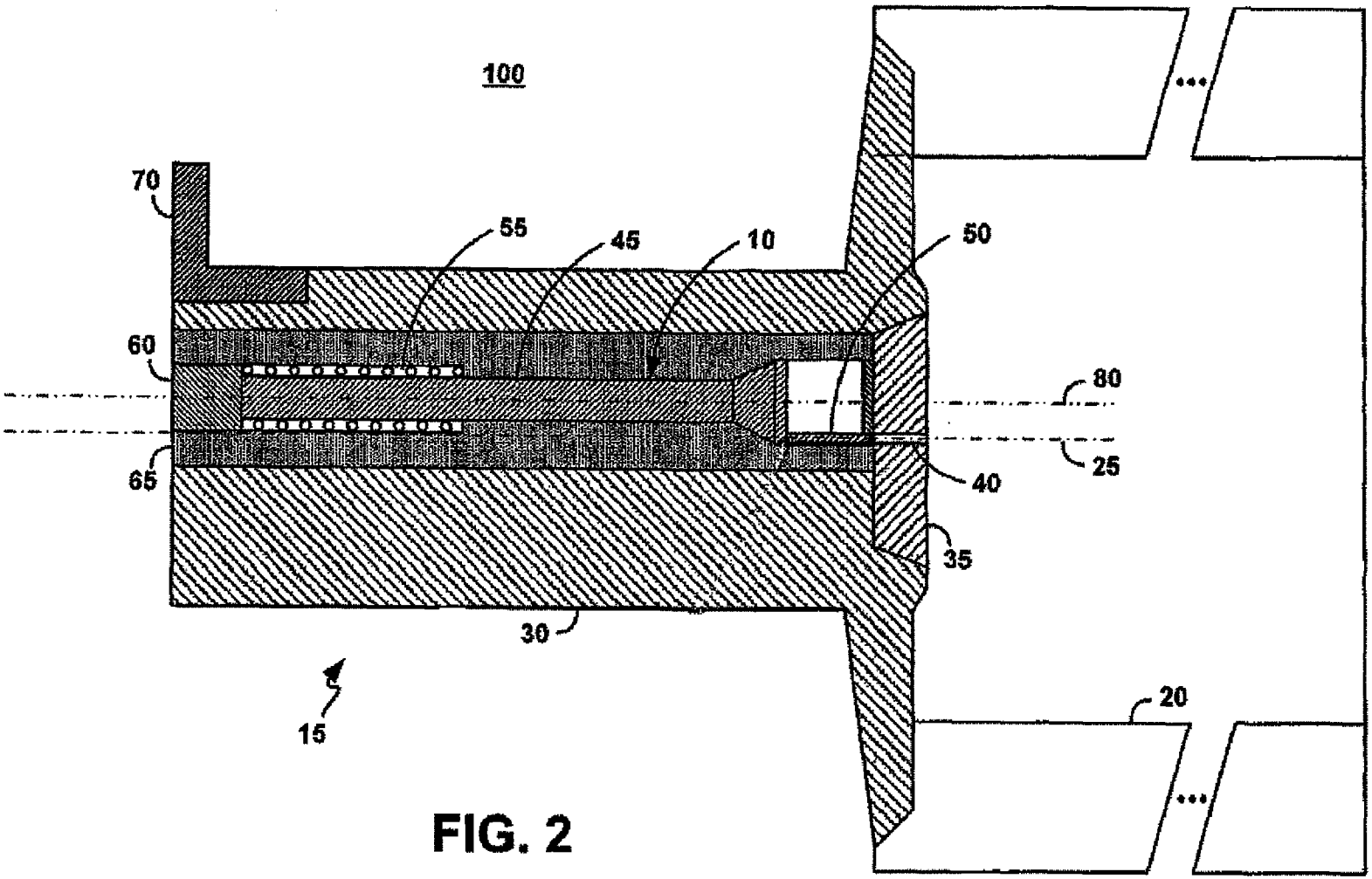
FIG. 2 is a schematic illustration in which the screw-block assembly is rotated and locked such that a firing pin of the revolving firing pin system is properly aligned for striking a primer of a munition loaded in the screw-block breech-loading mortar system of FIG. 1.

FIG. 2 illustrates the screw-block assembly closed and locked, with the firing pin 50 aligned with the firing pin hole 40.

Figure 3:
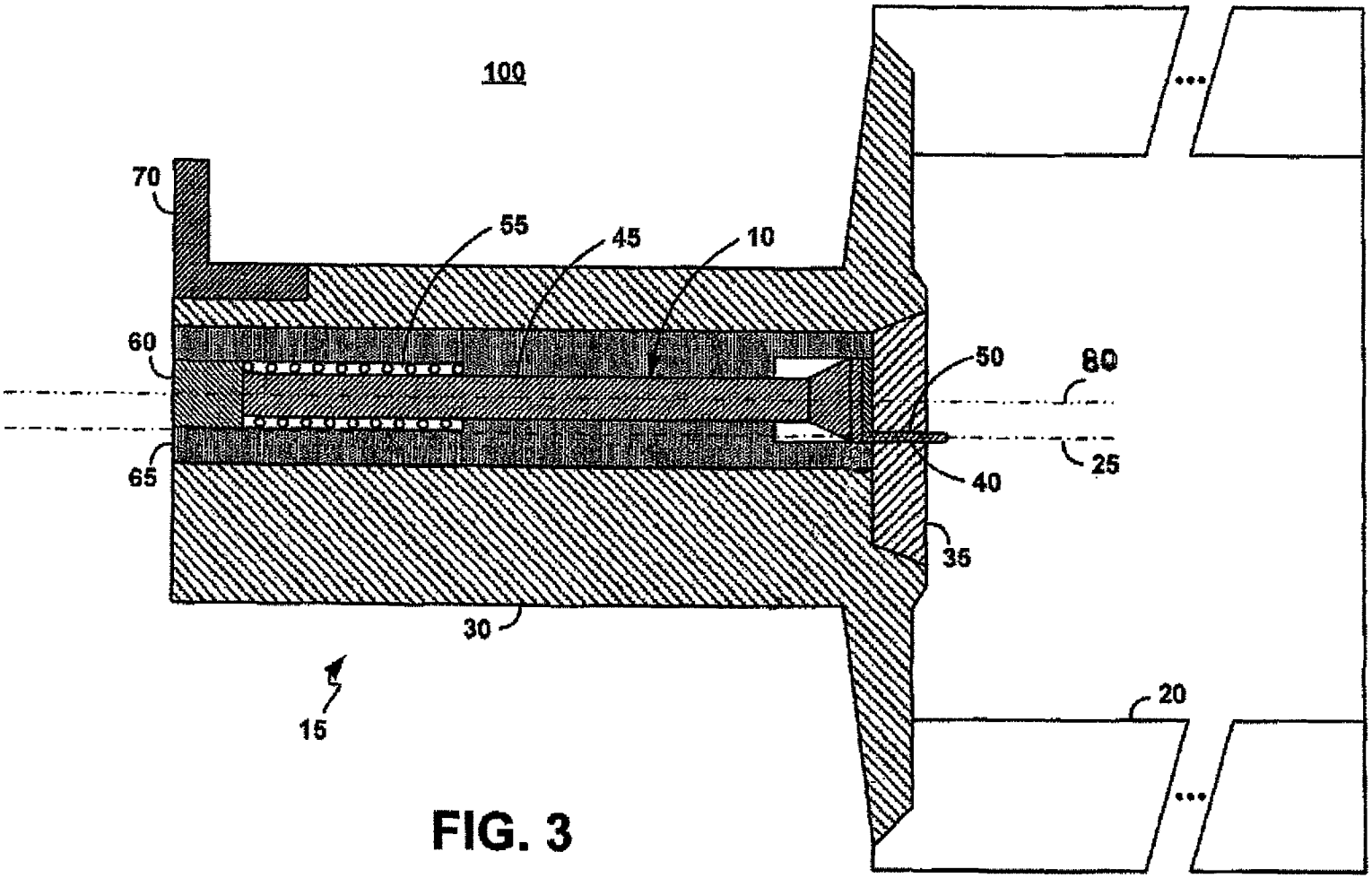
FIG. 3 is a schematic illustration of an exemplary screw-block breech-loading mortar system in which a solenoid of the revolving firing pin system is actuated and the firing pin is extended for striking a primer of a munition loaded in the screw-block breech-loading mortar system of FIG. 1.

FIG. 3 illustrates the screw-block assembly 15 closed and locked, with the solenoid 45 actuated and the firing pin 50 extended through the firing pin hole 40 for striking the primer of a munition loaded in the mortar system 100.

Figure 4A:
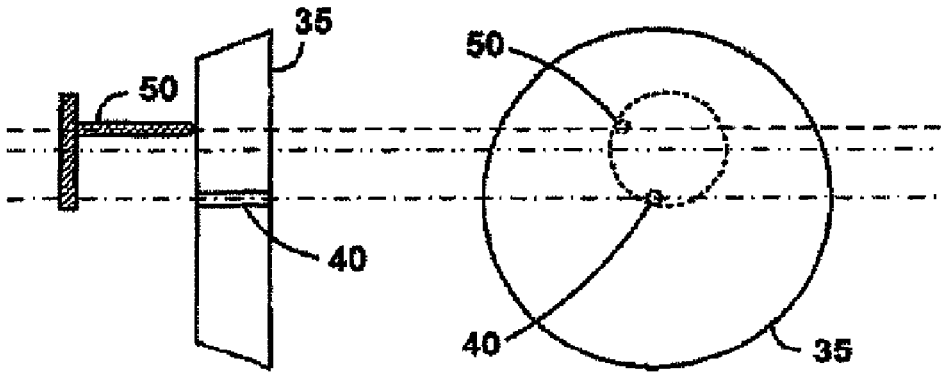
FIG. 4 is comprised of FIGS. 4A and 4B and represents a schematic illustration of a breech view of a spindle cap of the screw-block breech-loading mortar system of FIG. 1 illustrating positioning of the firing pin when the screw-block assembly is closed and when the screw-block assembly is closed and locked.
Figure 4B:
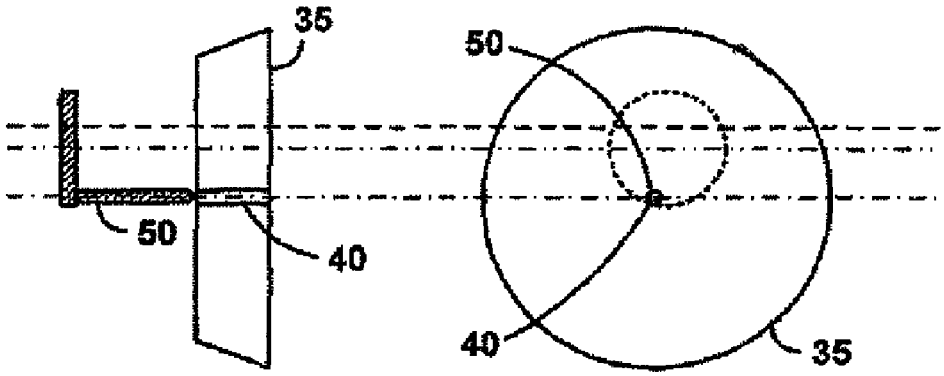

FIG. 4 (FIGS. 4A and 4B) illustrates a diagram of a breech view of the screw-block assembly 15 with the location of the firing pin 50 indicated. In FIG. 4A, the firing pin 50 is shown in the safety position, out of alignment with the firing pin hole 40. As the screw block assembly 15 is closed and locked, the firing pin 50 rotates counter clockwise into alignment with the firing pin hole 40, as illustrated by FIG. 4B.

Figure 5:
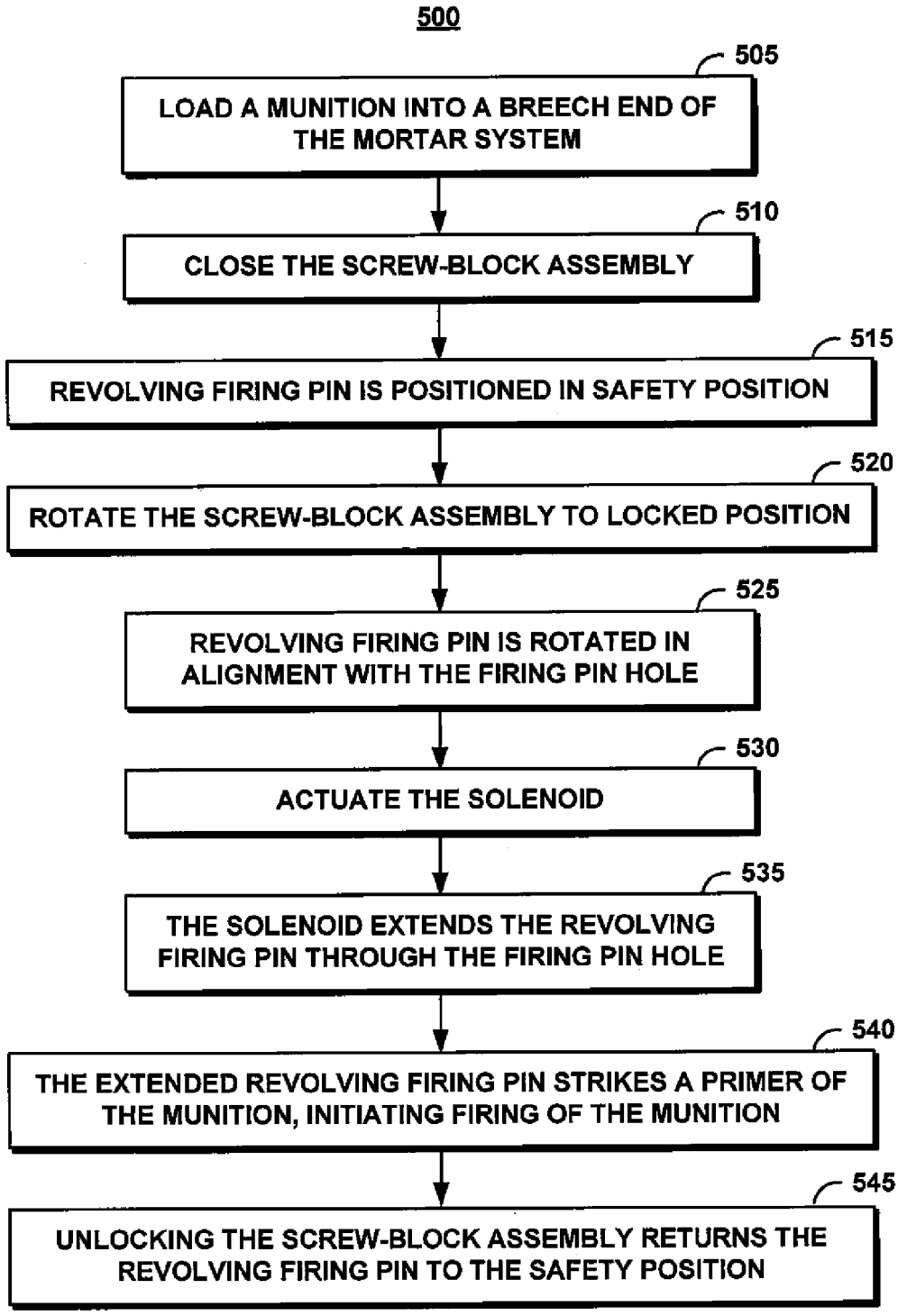
FIG. 5 is a process flow chart illustrating a method of operation of the revolving firing pin system of FIG. 1.

FIG. 5 illustrates a method 500 of operation of a screw-block breech-loading mortar system 100 utilizing a revolver firing pin assembly 65. A munition is loaded into the breech end of the screw-block breech-loading mortar system 100 (step 505). The screw-block assembly 15 is closed (step 510). When the screw-block assembly 15 is closed, the revolving firing pin 50 is in the safety position (step 515). The screw-block assembly 15 is rotated to the locked position (step 510). Rotating the screw-block assembly 15 to the locked position rotates the revolving firing pin 50 into alignment with the firing pin hole 40 (step 525). The solenoid 45 is actuated (step 530). The solenoid 45 extends the firing pin 50 through the firing pin hole 40 (step 535). The extended revolving firing pin 50 strikes a primer of the loaded munition, initiating firing of the munition (step 540). Unlocking the screw-block assembly 15 by rotating the screw-block assembly 15 to the unlocked position returns the revolving firing pin 50 to the safety position (step 545).

It is to be understood that the specific embodiments of the invention that have been described are merely illustrative of certain applications of the principle of the present invention. Numerous modifications may be made to the revolving firing pin system described herein without departing from the spirit and scope of the present invention. Moreover, while the present invention is described for illustration purpose only in relation to a mortar system, it should be clear that the invention is applicable as well to, for example, any breech-loading weapon system.

What is claimed is:

1. A revolving firing pin system for use in a screw block assembly of a breech-loaded weapon system whose ignition is solenoid activated, said revolving firing pin system preventing an unintentional ignition of the firing pin by aligning the firing pin into a safety position when the screw block assembly's breech is not closed and properly locked, the revolving firing pin system further comprising:

a spindle and a spindle cap in the screw block assembly, wherein the spindle cap defines a firing pin hole that is offset relative to a center axis of the firing pin system; a revolving firing pin assembly that rotates about said center axis to position the firing pin in alignment with the firing pin hole upon locking the screw block assembly's screw block; and wherein the firing pin has a contact finger that extends through the firing pin hole along an axis substantially parallel to said center axis;

wherein the revolving firing pin is in position to strike a primer of a munition loaded in the breech-loading weapon system only when the revolving firing pin is aligned with said firing pin hole.

2. The revolving firing pin system of claim 1, wherein the firing pin hole is offset relative to the center axis of the firing pin system by a predetermined offset distance.

3. The revolving firing pin system of claim 2, wherein the predetermined offset distance is approximately 5 mm.

4. The revolving firing pin system of claim 2, wherein the firing pin contact finger is approximately 17.5 mm in length and approximately 3 mm in diameter.

5. The revolving firing pin system of claim 2, wherein the firing pin hole is approximately 3 mm in diameter.

6. The revolving firing pin system of claim 2, wherein the weapon system is a 120 MM breech loaded Mortar weapon.

7. The revolving firing pin system of claim 2, wherein the weapon system employs a cannon.

* * * * *